US005845353A

United States Patent [19]

Chow

[11] Patent Number: 5,845,353

[45] Date of Patent: Dec. 8, 1998

[54] WATER BED WITH INTERNAL AIR FILLED TUBES

[76] Inventor: Andy Chow, 4F, No. 27, Lane 20, Hsing Tung Street, Taipei, Taiwan

[21] Appl. No.: 988,039

[22] Filed: Dec. 10, 1997

[30] Foreign Application Priority Data

Dec. 18, 1996 [TW] Taiwan ..... 85219595

[51] Int. Cl.[6] ..... A47C 27/10

[52] U.S. Cl. ..... 5/685; 5/680; 5/681; 5/687

[58] Field of Search ..... 5/668, 665, 678, 5/680, 681, 685, 687

[56] References Cited

U.S. PATENT DOCUMENTS

| | | | |
|---|---|---|---|
| 4,310,936 | 1/1982 | Benjamin | 5/687 |
| 4,558,476 | 12/1985 | Linder | 5/682 |
| 4,597,120 | 7/1986 | Fogel et al. | 5/685 |
| 4,901,386 | 2/1990 | Lane | 5/687 |
| 4,912,789 | 4/1990 | Maxwell | 5/680 |
| 5,507,048 | 4/1996 | Mauser et al. | 5/685 |
| 5,727,269 | 3/1998 | Chung | 5/680 |

*Primary Examiner*—Alex Grosz
*Attorney, Agent, or Firm*—Rosenberg, Klein & Bilker

[57] ABSTRACT

An improvement for a water bed includes a pair of water bed mattresses housed in a bed cover. There is a heat insulating foam or air bag sandwiched between the two water bed mattresses. Each water bed mattress has a plurality of transverse partitions to reduce water vibration and turbulence therein. The disclosed structure has the advantage of not only improving the stability, but also lengthening the durability of the water bed mattress. A plurality of longitudinal air tubes run through the transverse partitions and communicate with an air bag for providing a desired softness of the water bed mattresses to suit an individual user's requirements. Moreover, the disclosed water bed mattress is able to support a user's back bone comfortably, and minimize the quantity of water used for the mattress to reduce its weight.

10 Claims, 4 Drawing Sheets

WATER BED WITH INTERNAL AIR FILLED TUBES

BACKGROUND OF THE INVENTION

1. Field of the Invention

This invention relates to an improvement for a water bed. More particularly, this invention is directed to an improvement which can reduce water turbulence within a water bed. The improved structure of a water bed according to the present invention is characterized by two water bed mattresses whose degree of resiliency and temperature can be individually adjusted according to the different requirements of a couple sleeping on the bed.

2. Prior Art

Conventional water beds usually employ high frequency fusion to form an air cushion flange around the water bed. The abrupt change of water pressure caused by external forces and the rapid and turbulent movement of water can rupture the flange at the fusion portion and results in water leakage. The resiliency of a conventional water bed is difficult to adjust and the bed body is not sufficiently stable. Moreover, the mattress (including those with or without air bounding peripheries) itself is loosely constructed to form a configuration having a flat circular flange. That structure is not only unattractive in its appearance, but also dangerous to a person sleeping on it, as the person may accidentally slip down. Serious swinging or vibration caused by moving of a person sleeping on the bed often disturbs and awakens another person on the bed. Further, the water contained in a conventional standard size water bed is not isolated by any separator, consequently, there is no difference in temperature and resiliency between two sides of the bed to meet the different requirements and habit that the individuals of a coupled sleeping on the bed may have. Thus, each individual of the couple must tolerate each other. A standard size water bed has the same temperature level and level of softness, which could become a problem when two people lying on it have different sleeping habits and requirements.

SUMMARY OF THE INVENTION

In view of the above described disadvantages of a conventional water bed, it is therefore an object of the present invention to develop an improved structure of water bed in which a plurality of transverse partitions are installed in the mattress which are able to effectively dampen rapid longitudinal water flow from end to end of the mattress. A plurality of through holes are provided in each partition for permitting a small amount of water to seep therethrough and alleviate water pressure. In this way, an abrupt variation of water pressure caused by instantaneously applying a heavy weight on the mattress can, to a great extent, be effectively alleviated. The present invention is not only able to maintain a very stable state of the mattress, but can also prevent the destruction of high frequency fused partitions in the mattress, as may be caused by a strong water hammer phenomenon.

It is another object of the present invention to provide a mattress having a plurality of air tubes passing over the above described transverse partitions. An air inlet is provided for an air bag installed at one side of the mattress for adjusting the resiliency of the mattress by injection of air therein, and air tubes to make the mattress suitable for the different weight and physical characteristics of individuals users. Therefore, the mattress of the water bed may effectively support and contact every portion of the user's body when the user is lying on his or her back, or on his or her side. Thus, the effect of complete support and profound rest of the user by lying on a water bed of the present invention can be achieved from the viewpoint of human body engineering.

It is another object of the present invention to apply a 4-side high frequency fusion to the above described plurality of transverse partitions to form a mattress well filled and configured symmetrically.

It is yet another object of the present invention to provide a water filled mattress in two parts that are combined in one piece to form a mattress unit for a standard size water bed. By such arrangement, a couple lying on the bed may individually adjust the temperature and resiliency of their own sub-mattress to suit their own requirements and weight, without disturbing the other person. Thus, the aim of providing for a user's profound sleep and protecting a user's back bone will be obtained.

A further object of the present invention is to provide, in case the water leaks because of a deterioration of a high frequency fused partition, a special protecting means. The protecting means is provided by a bed cover for the whole mattress that prevents any leaking water from seeping out of the mattress and keeps the water in the water bed cover, so the bedroom floor won't be wet. In addition, detachable rectangular shaped holes are provided at both end portions of the water bed cover for the convenience of individually inserting or replacing the sub-mattresses.

BRIEF DESCRIPTION OF THE DRAWINGS

The invention, as well as its many advantages may be further understood by the following detailed descriptions and drawings in which.

DETAILED DESCRIPTION OF THE PREFERRED EMBODIMENT

Figure 1:
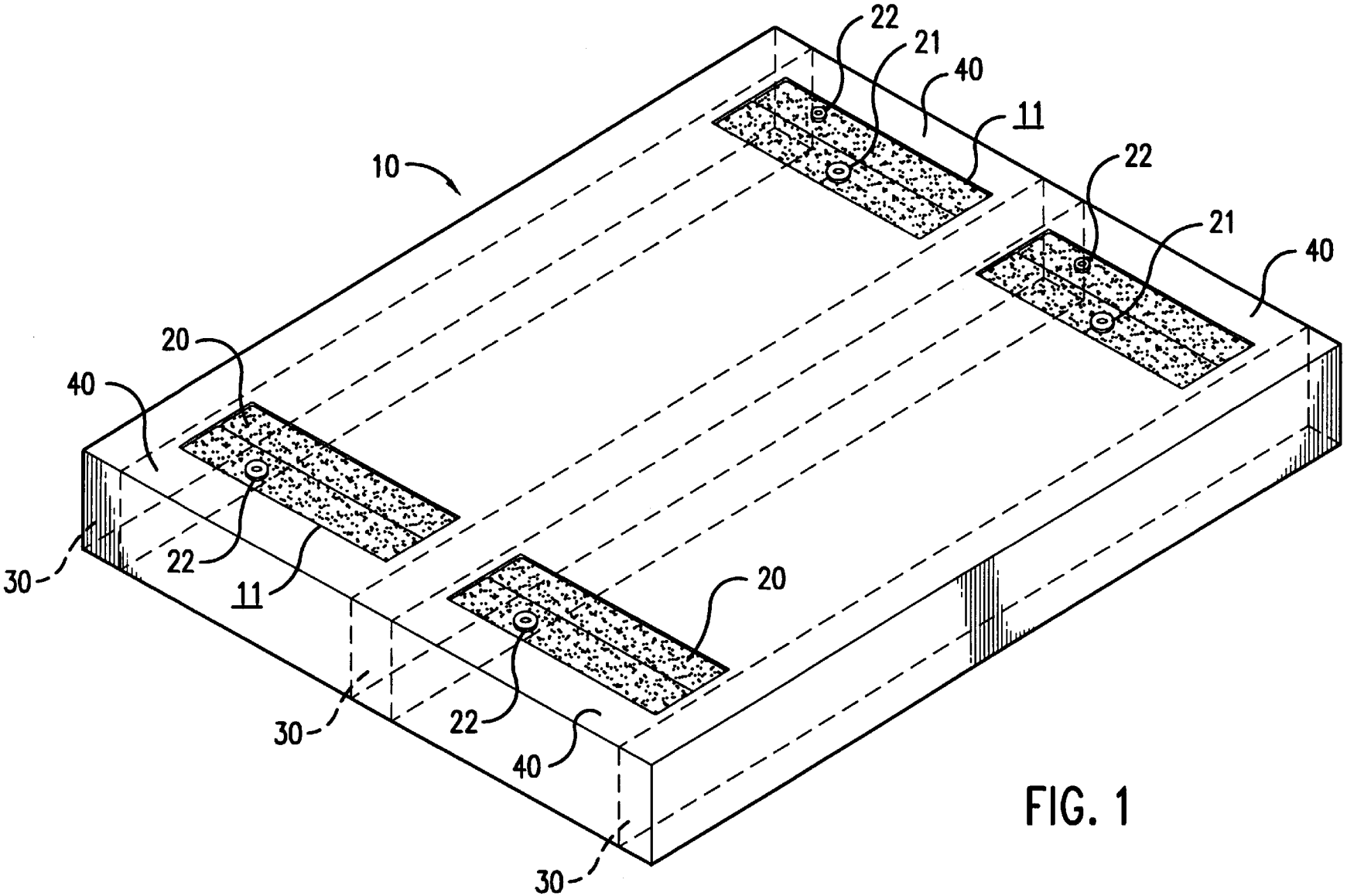
FIG. 1 is a perspective view of the present invention.
Figure 2:
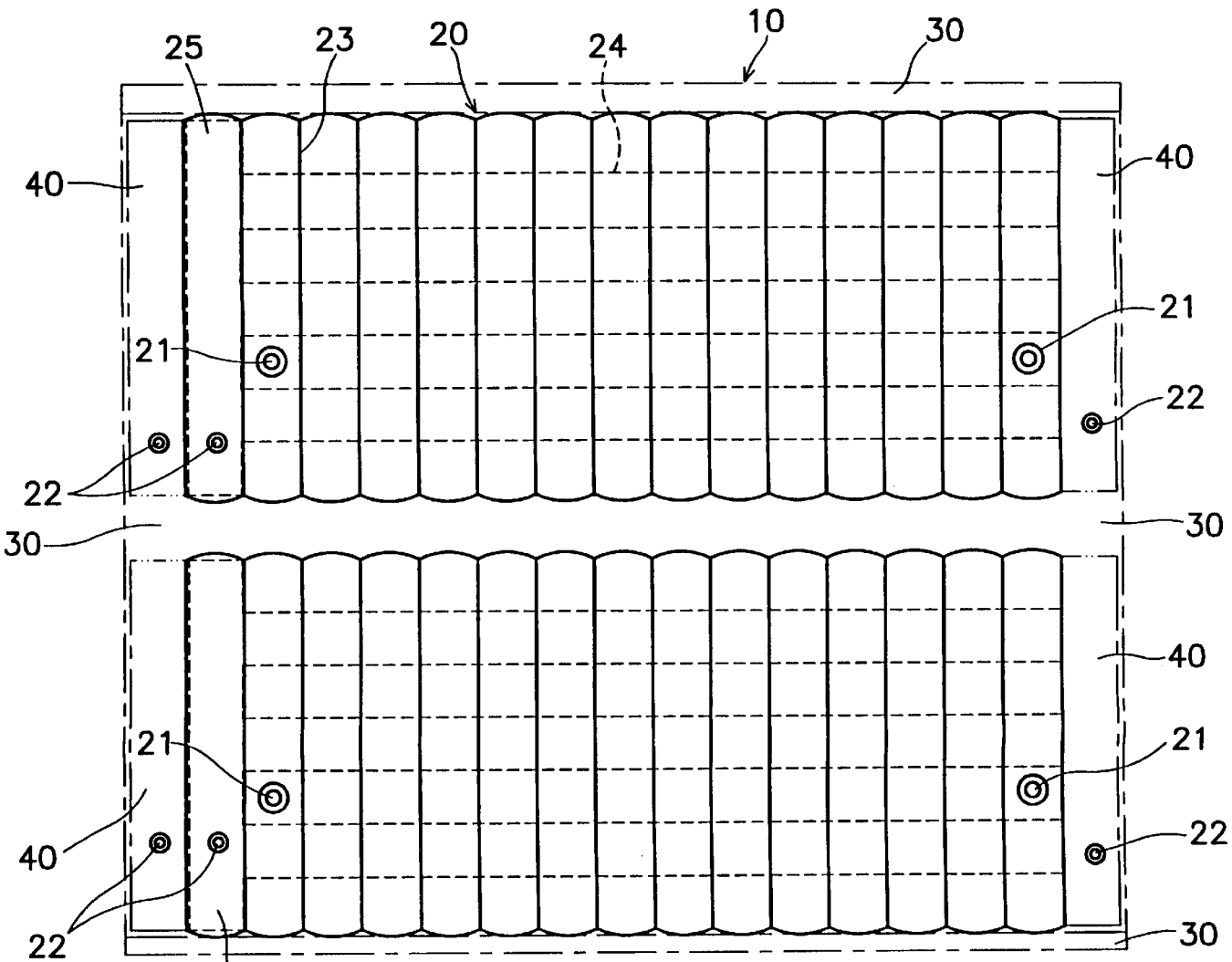
FIG. 2 is a bottom view of the present invention.

Referring to FIGS. 1 and 2, the water bed according to this invention includes a water bed cover 10, two separate water bed mattresses 20 and a rectangular separator 30 made of foam or an air bag which keeps the water bed mattresses 20 apart so that each water bed mattress 20 may have a different softness and temperature. The four lateral sides of the bed cover 10 may be padded with foam or air bags to make the mattress well filled and shaped in a symmetrical configuration. The two ends 40 of each water bed mattress may also be padded with a foam or air bags for a like purpose. At the two ends of the top surface of the bed cover 10, there are two cut off openings 11 which enable the water bed mattress 20 to be inserted, or removed therethrough. Each water bed mattress 20 has a pair of water inlets 21 and air inlets 22 located in the opening 11.

Figure 3:
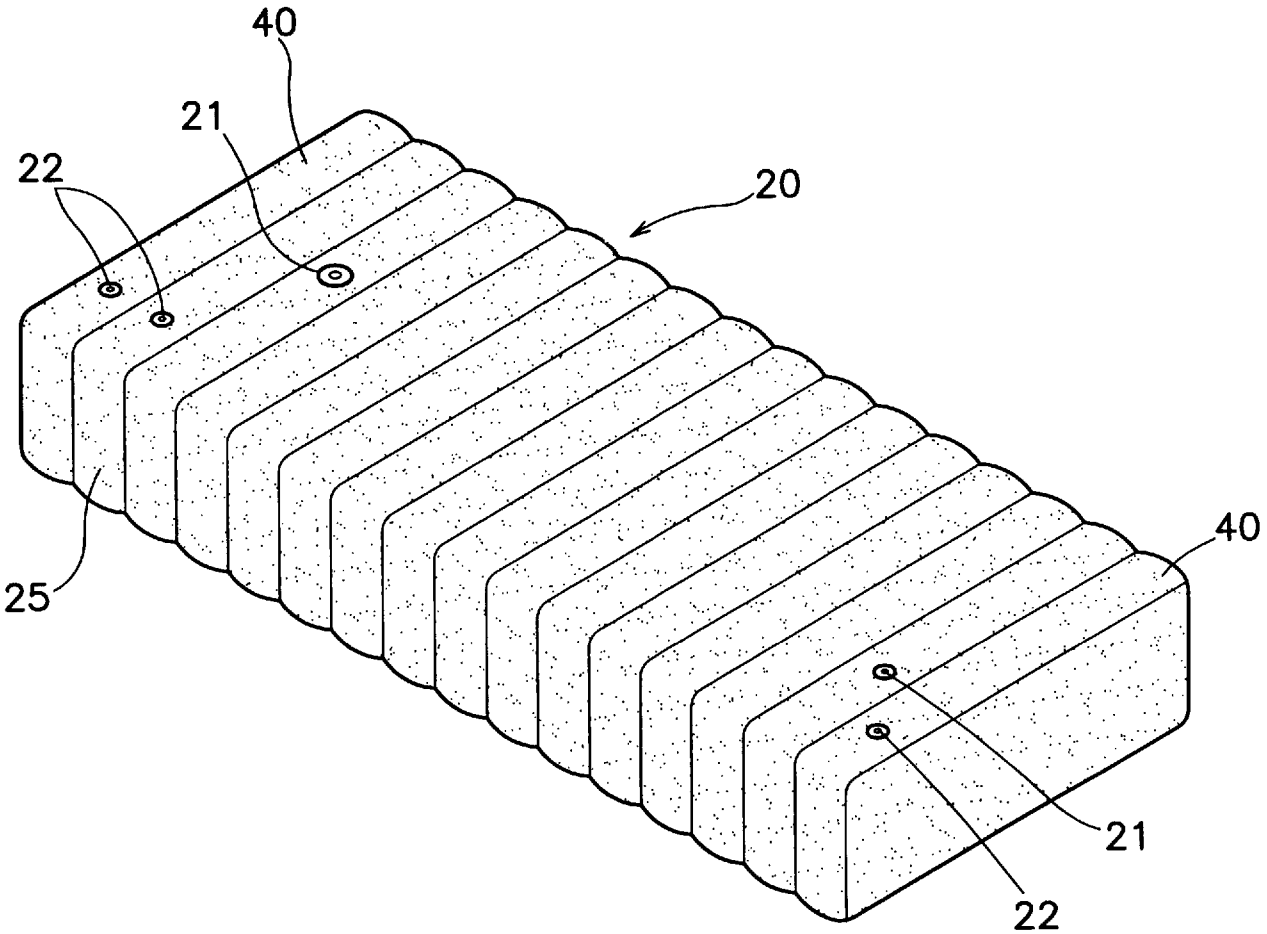
FIG. 3 is a perspective view of the water bed mattress of the present invention.
Figure 4:
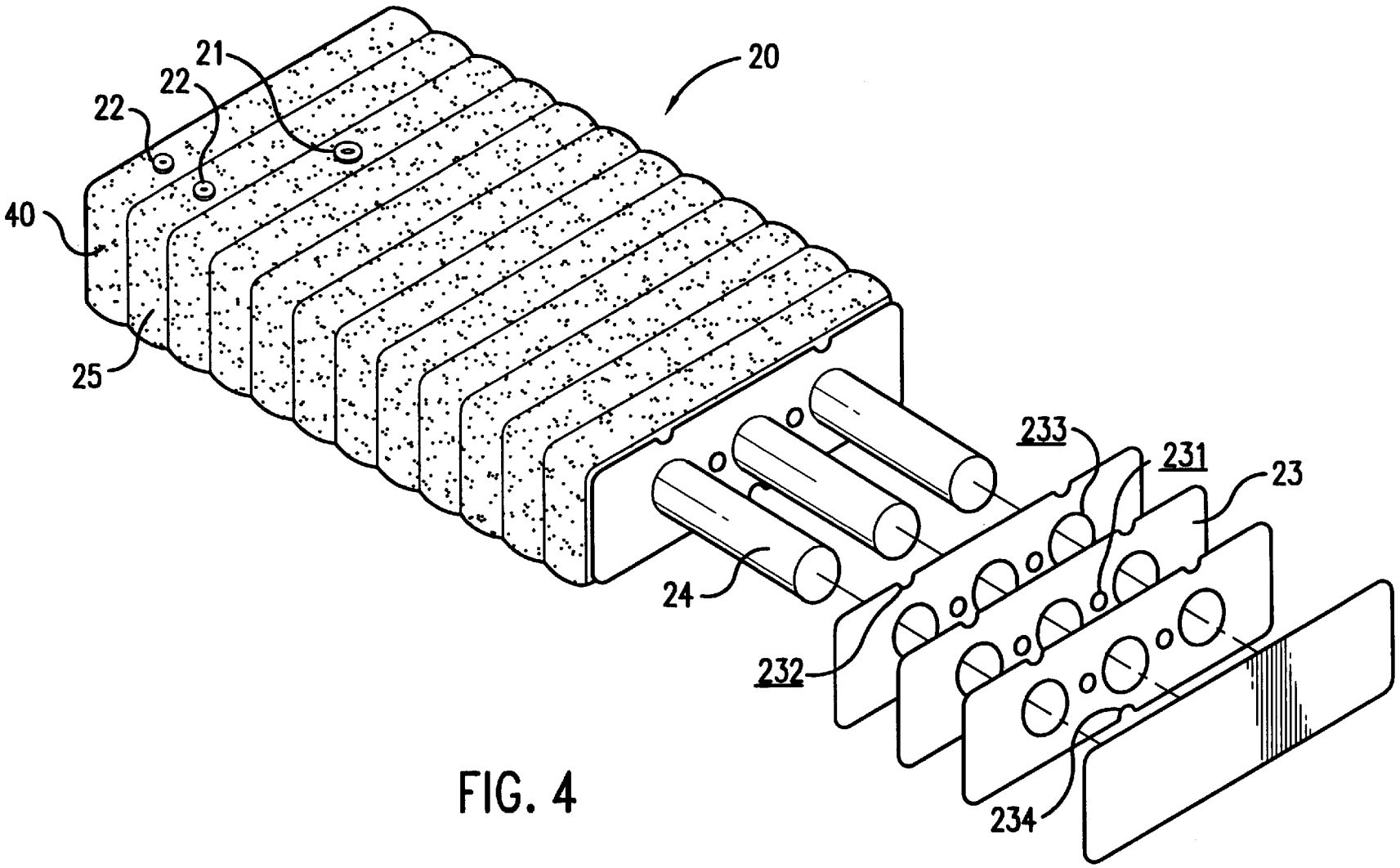
FIG. 4 is an exploded view of the water bed mattress of the present invention.

Referring additionally to FIGS. 3 and 4, the water bed mattress 20 includes a plurality of transverse partitions 23. The four sides of each partition 23 are fixed on the inside surfaces of the water bed mattress 20 via high frequency fusion. The transversely arranged partitions 23 can effectively alleviate the water hammer phenomenon that results from an abrupt variation of water pressure inside the water bed mattress 20. Each partition 23 has a plurality of openings 231 to facilitate water pressure leveling within the water bed mattress 20.

Each partition 23 further has two air openings 232 to allow air in the water bed mattress 20 to be expelled during the water filling process. Each partition 23 also has a water inlet opening 234 to enable water to fill the water bed mattress 20. Each water bed mattress 20 further has a plurality of longitudinal air tubes 24 running through the partitions 23 via opening 233. The air tubes 24 are in fluid communication with an air bag 25 located at one end of the water bed mattress 20.

Through the air inlet 22, pressurized air may be pumped into the air bag 25 and the air tubes 24. Therefore, the softness of the water bed mattress 20 may be changed and adjusted as desired. The amount of water in the water bed mattress 20 also may be changed to produce different levels of softness. The transverse partitions 23 and the openings 231 can produce a damping effect to reduce the water vibration and turbulence within the water bed mattress 20, while an external force is applied on the water bed 10. As the water bed 10 includes two separate water bed mattresses 20, each water bed mattress 20 may have a different amount of water, different air pressure and different water temperature to suit a different person's need.

It may thus be seen that the objects of the present invention as set forth herein, as well as those made apparent from the foregoing description are efficiently attained. While the preferred embodiment of the invention has been set forth for purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A water bed comprising:

a pair of separate water bed mattresses (20), each of said water bed mattresses (20) having a plurality of transverse partitions (23) fixed to respective inside surfaces of said water bed mattress by high frequency fusion on four sides thereof, each of said plurality of transverse partitions (23) having a plurality of through openings (231) formed therein for water to flow through said plurality of openings (231), an air opening (232), a water inlet opening (234), and a plurality of air tube openings (233), each of said water bed mattresses (20) having a water inlet (21) at one end thereof;

a plurality of air tubes (24) extending longitudinally through said air tube openings (233);

an air bag (25) located adjacent one end (40) of each of said pair of water bed mattresses (20) in fluid communication with said plurality of air tubes (24) and having an air inlet opening (22) formed therein; and a bed cover (10) for housing said pair of water bed mattresses (20).

2. The water bed of claim 1 further comprising heat insulating means (30) located between said pair of water bed mattresses (20).

3. The water bed of claim 2, wherein said heat insulating means (30) includes a foam member.

4. The water bed of claim 2, wherein said heat insulating means (30) includes a longitudinally extended air bag.

5. The water bed of claim 1 further comprising heat insulating means (30) located on each lateral side of each said water bed mattress (20).

6. The water bed of claim 5, wherein said heat insulating means (30) includes a plurality of foam members.

7. The water bed of claim 5, wherein said heat insulating means (30) includes a plurality of longitudinally extended air bags.

8. The water bed of claim 1, wherein said bed cover (10) has a rectangular opening (11) at each of two opposing ends thereof for passage of a respective water bed mattress (20) therethrough.

9. The water bed of claim 1, further comprising a pair of rectangular foam members located respectively at two opposing ends (40) of each of said water bed mattresses (20) to pad and shape each said water bed mattress (20) in a symmetrical configuration.

10. The water bed of claim 1, further comprising a pair of air bags located respectively at two opposing ends (40) of each of said water bed mattresses (20) to pad and shape each said water bed mattress (20) in a symmetrical configuration.

* * * * *